United States Patent [19]

Markiewicz et al.

[11] Patent Number: 4,978,936

[45] Date of Patent: Dec. 18, 1990

[54] SUPERCONDUCTING MAGNETIC COIL ELEMENT HAVING TERMINALS BONDED TO THE COIL BODY

[75] Inventors: W. Denis Markiewicz; Gary Ciancetta, both of Schenectady; Philip Jonas, Albany, all of N.Y.

[73] Assignee: Intermagnetics General Corporation, Guilderland, N.Y.

[21] Appl. No.: 163,527

[22] Filed: Mar. 3, 1988

[51] Int. Cl.[5] ..... H01F 7/22

[52] U.S. Cl. ..... 335/216; 335/299; 439/874; 29/599

[58] Field of Search ..... 335/216, 299; 439/874; 336/192; 174/15.4; 29/599; 505/1

[56] References Cited

U.S. PATENT DOCUMENTS

| | | | |
|---|---|---|---|
| 3,408,604 | 10/1968 | Doi et al. | 335/216 |
| 3,559,128 | 1/1971 | Kingston et al. | 335/216 |
| 3,983,521 | 9/1976 | Furuto et al. | 335/216 |

FOREIGN PATENT DOCUMENTS

| | | | |
|---|---|---|---|
| 77109 | 6/1980 | Japan | 335/216 |
| 281405 | 12/1987 | Japan | 335/216 |

OTHER PUBLICATIONS

Progress in High Field Solenoids Using Filamentary, $Nb_3Sn$; P. Jarvis, N.J., Mellons Proceedings, 9th International Conference on Magnet Technology, Zurich, Switzerland, 1985, pp. 406–408.

"600 MHZ Spectrometer Magnet"; John E. C. Williams, S. Pourrahimi and L. Motowidlo, Manuscript Received Aug. 22, 1988 for Publication in Proceedings, Applied Superconductivity Conference, 1988, pp. 1–4.

*Primary Examiner*—George Harris

*Attorney, Agent, or Firm*—Helfgott & Karas

[57] ABSTRACT

A superconducting magnetic element is provided wherein the terminals are bonded to the coil body and are independent of that coil body supporting structure. The technology employs a terminal structure with a supporting base member surrounding a conductor terminal end portion positioned on a surface of an impregnated coil body and integrally bonded thereto. The terminal structure in turn permits freedom in manufacturing to employ all useful strategies in accommodating physical properties of different materials.

11 Claims, 4 Drawing Sheets

SUPERCONDUCTING MAGNETIC COIL ELEMENT HAVING TERMINALS BONDED TO THE COIL BODY

BACKGROUND OF THE INVENTION

The invention is in the field of manufacturing superconducting magnetic elements. Such elements have a coil of conductors that is operated in the superconductive state.

The manufacture of such superconductive coils requires the accommodation of limitations produced by the physical property differences and the relative variations of the physical properties of the materials employed in the structure when subjected to the conditions encountered by the element in manufacture and operation in service.

Superconducting magnetic elements provide a high field that is achieved by the large current that flows in the conductors of the coil under the essentially zero resistance condition of superconductivity. In the manufacture of such an element, a number of interdependent and sometimes conflicting considerations are encountered.

In the general practice of manufacturing magnetic coil elements the physical property of ductility in the conductor material permits its shaping during winding of the coil and accommodates relative thermal expansion and operating stresses for leads. However, the physical property of ductility cannot be relied on as always being available in the superconductive materials used for conductors.

In general the conductor materials that exhibit superconductivity fall into groups of those considered to be reasonably ductile and those which are considered to be brittle. Materials are now appearing in the art that can only be formed by placing the ingredients in the desired shape and then subjecting that shape to conditions, such as a prolonged heat cycle at high temperature, that completes the reaction of the ingredients. The use of such conductor materials will require extreme care in terminal construction and will add to the temperature range that the element must accommodate.

Each of the materials usable as a superconducting magnetic element conductor has a temperature below which there is an abrupt transition in electrical properties from resistance to superconductive. For conventional Nb based superconducting materials, these transition temperatures can be very low, and the magnetic elements fabricated of these materials are typically operated in the neighborhood of the boiling point of liquid helium, approximately 4.2 degrees K. Thus, the assembly of materials that comprise the magnetic element must be able to withstand relative thermal expansion of the individual parts over a range of temperatures from room temperature where assembly usually occurs, to the high temperature of a required heat treatment to form the superconductor, and to the temperature of superconducting operation, which may be very low.

The performance of a superconductive magnetic element comprising conventional Nb based superconducting material is sensitive to localized inputs of heat. The heat capacities of these materials at the low operating temperatures of these superconductors are very low, and small inputs of heat result in relatively large increases in temperature. When a localized region is heated to the transition temperature and becomes resistive the effect propagates throughout the element producing a dramatic change in electrical performance generally resulting in a malfunction of the element.

One source of localized heat is relative motion between portions of conductors. This situation is usually controlled in the art by impregnation of the coil windings with a material that fills all the interstices between conductors.

Another source of localized heat is relative motion between the conductors of the coil and any housing, such as a coil form member employed in winding the coil and continuing as a support when the element is in service.

Three strategies have evolved in the art to address the localized heat problem. (1) A sufficiently strong bond with the coil form can be provided to prevent the relative motion; (2) a material can be introduced to prevent any bonding to the coil form, and (3) the coil can be removed from the coil form for remounting in a bond free supporting structure. All strategies, however, require consideration of the effect on the terminals of the coil during both manufacture and service.

Magnets constructed of conductors of niobium titanium (NbTi) is an example of prior art ductile superconductors.

Independent of the detailed process employed to fabricate an impregnated niobium titanium coil, the leads have properties characteristic of a ductile alloy and the typical design of leads and terminals reflect these properties. In the prior art, terminals are mounted to a flange or other coil structure, and leads connect the coil and terminals through holes in or around the periphery of the coil form. The leads can incorporate some additional low conductivity material beyond that present generally in the conductor in the windings to aid electrical and mechanical stability. The leads remain ductile to an extent required to accommodate the strains to which they are subjected.

Strategies (1), (2) and (3) above may be adopted with NbTi leads of the prior art. Inherent in strategies (2) and (3) are allowed relative motions of coil form and windings. The strains at the leads associated with the relative motions are accommodated by the ductile nature of the leads. Strategy (1), if successfully applied, eliminates relative motion of coil form and windings, and thereby eliminates significant strains on the leads. However, in the case that strategy is only partially successful and local debonding does occur in the neighborhood of the leads, lead failure is prevented to the extent that the ductile nature of the leads can accommodate the strains.

Magnets constructed of conductors incorporating niobium tin ($Nb_3Sn$), including niobium tin with third element additions, is introduced as an example of prior art applicable to brittle superconductors.

Niobium tin coils can be fabricated by one of two methods with respect to the order of winding and reaction of the conductor. In the wind and react technology, the coil is wound of non-reacted conductor. The conductor is then reacted in place on the coil form. In the react and wind technology, the conductor is reacted before winding, usually on a fixture. The coil is then wound of the reacted conductor.

Independent of the detailed process employed to fabricate an impregnated niobium tin coil, the leads have properties characteristic of a brittle compound, and the designs of leads and terminals in the prior art reflect these properties.

In the prior art, terminals are mounted to a flange or other coil structure, and leads connect the coil and terminals through holes in or around the periphery of the coil form. The leads are brittle after the conductor is reacted whether that be before the magnet is wound as in react and wind or after the magnet is wound and heat treated as in wind and react. The strains on the leads must be strictly limited to prevent damage to the superconductors.

Strategy (1) above is usually adopted in the prior art of impregnated $Nb_3Sn$ coil construction. To the extent that bonding to the coil form eliminates relative motion of coil form and windings at the leads, the $Nb_3Sn$ leads are protected from detrimental strains. However, in the case that strategy (1) is only partly successful and local debonding does occur in the neighborhood of the leads, lead failure is a possibility due to the brittle nature of the lead material.

Strategy (2) may be adopted within the boundaries of the prior art if a region of strain relief is included in the length of lead between the coil winding and the terminal. A length of lead in the shape of an arc or portion of a loop might be left without rigid support with the intent of accommodating small relative displacements of the constrained ends of the lead with only small strains on the brittle lead itself.

Strategy (3) is outside the prior art to the extent that removal of the coil form from an impregnated $Nb_3Sn$ coil without special lead support leaves the lead susceptible to damage from even the small strains typical of subsequently connected leads to terminals.

SUMMARY OF THE INVENTION

The invention is providing of the technology that provides a unitary superconducting magnetic element wherein all external interfaces involving conductors in the coil body are constructed so that each is integrally bonded with the body of the coil in a self supporting structure that accommodates manufacturing and service stresses yet relaxes if not eliminates such constraints as are produced by brittleness of conductor materials, relative expansion and mechanical connection stresses.

The advantages of the invention are achieved by a local terminal structure with a base which is bonded to the body of the coil windings and thereby eliminates detrimental strains on the portion of the conductor which forms a lead from the coil winding to a region where an electrical connection is made to external leads, or other internal leads. The strain on the lead is eliminated by virtue of the bond between the terminal base and the coil body which eliminates relative motion between the coil body and terminal, and therefore the lead. The integrity of the bond from the terminal base to the coil body is maximized by the local nature of the terminal base.

In the present context, a bond to a coil body is considered local if the area of the bond is a small fraction of the area of the coil surface to which the bond is made.

The present invention allows adoption of strategy (3) above for superconducting magnets which employ brittle superconductor, without the risk to the magnet leads when the coil form is removed. The present invention allows adoption of strategy (2) above for superconducting magnets which employ brittle superconductors, without the risk to magnet leads inherent in a length of lead which is not rigidly supported in order to provide a strain relief at the lead.

The present invention allows adoption of strategies (2) and (3) above for superconducting magnets which employ ductile superconductors, as a possible improvement of the prior art practiced with such magnets.

The present invention further since it can accommodate the physical properties of both ductile and brittle superconductor materials allows the adoption of strategies to accommodate the high transition temperature metal oxide ceramic superconductor materials.

The stresses between coil windings and bonded coil form which occur during cool down and operation of a superconducting magnet are directly related to the extent of the bonded region along the surface of the coil. The coil form and coil each have preferred shapes and sizes which are different during operation and a bond between coil form and coil which forces coil form and coil to have the same size and shape will result in stresses at the interface. The stresses at the interface to a local lead support structure, bonded to a small fraction of a coil surface, will be reduced in comparison to the stresses at the interface to a structure which is bonded to essentially the entirety of that coil surface, for example, part of the coil form. The reduced stress on the interface to the local lead support makes it easier to design this interface to prevent debonding of the lead support.

Other features of the bonded lead support and terminal are related to its application to magnets constructed of brittle superconductor, and the typical processing employed with such coils.

The invention achieves many design advantages.

The design positions and holds the lead support and terminal hardware during coil winding.

The design provides for initial lead in and final lead out, and also for intermediate leads in and out that are required when several lengths of conductor are used in winding the coil.

The design of lead support and terminal for intermediate leads allows for uncertainty in conductor lengths and the resulting uncertainty in the position of intermediate leads at the start of winding.

The design permits the positioning and holding of lead wires constituting a joint.

The lead support and terminal hardware are compatible with the requirements to heat treat the coil to react the superconductor to its final state, typically at a temperature in the neighborhood of 700° C. for several days.

The lead support and terminal hardware allow for soldering the leads, or otherwise making good electrical contact to or between leads, after the reaction heat treatment.

The design holds the reacted leads rigidly in position during impregnation of the coil with epoxy, poyester or other impregnant. During impregnation, impregnant contacts the lead support and a bond is achieved upon cure or hardening of the impregnant.

The design allows for mechanical independence of the lead support and terminal from the coil form after impregnation of the coil.

In the light of the principles set forth it will be apparent to one skilled in the art that the invention although described by reference to a solenoidal type winding, is not limited to solenoids. The invention although described by its relation to the end flanges of a solenoidal coil form is not restricted to any particular relationship of the coil form or of any particular geometry. The invention is particularly well suited to the process used to produce a wind an react type $Nb_3Sn$ or $V_3GA$ material coil, but is not restricted to a particular conductor material, nor is it limited to wind and react conductor.

DETAILED DESCRIPTION OF THE INVENTION

In accordance with a preferred embodiment of the invention, a terminal structure is locally bonded to the body of a superconducting magnetic element, mechanically constraining a portion of conductor which forms a lead from the body of the coil to an electrical connection. The structure supports the conductor in both parallel and perpendicular stress directions with respect to the coil surface. The structure thus provides a terminal that is free of any ductility requirements on the part of the material used for the conductor in the coil.

For purposes of definition, the term magnet element may be considered to include such inductive reactances as solenoid and racetrack coils, the term terminal may be considered to include both external circuitry interfaces and the location for the joining of segments of the same winding.

Figure 1:
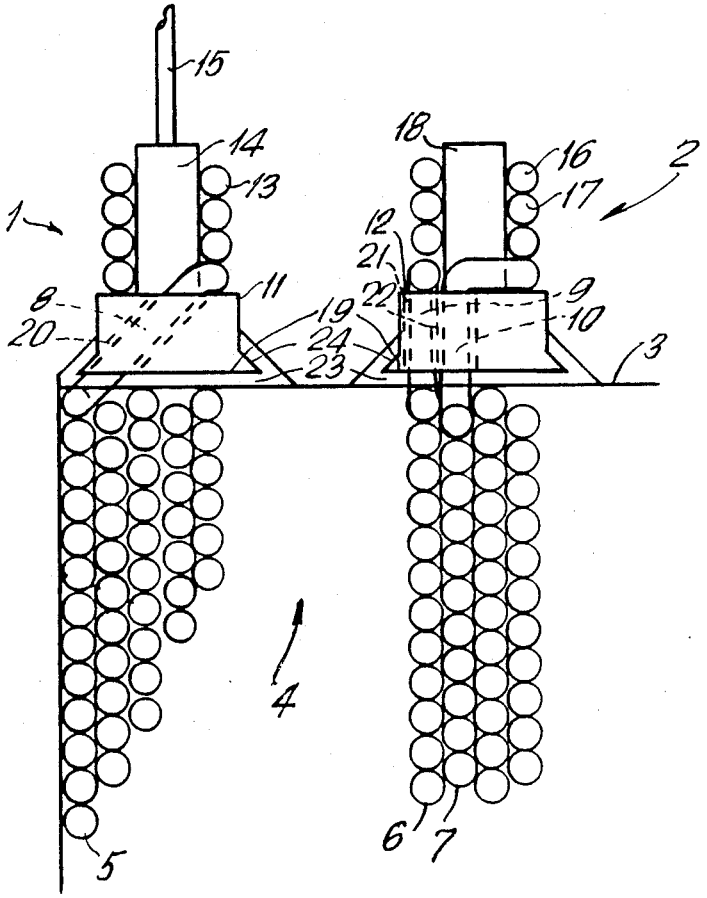
FIG. 1 is a cross sectional view illustrating the detail of the bonded terminal of the invention.

Referring to FIG. 1 terminal assemblies 1 and 2 are shown bonded to the surface 3 of the superconducting magnetic element coil 4. Terminal assembly 1 is illustrative of a terminal for a single conductor. Terminal assembly 2 is illustrative of a plurality of conductors connected together forming an intermediate joint in the coil winding. The coil 4 has layers of which 5, 6 and 7 are illustrative of ones having a portion of the conductor extending from the body of the coil 4. The portion of the conductors from layers 5, 6 and 7 extending through the surface 3 are labelled 8, 9 and 10 respectively. In the terminal of the invention the portion 8, 9, 10 of the conductor that extends from the surface 3 is supported and mechanically constrained by a terminal base member. The terminal base member in terminal 1 is labelled element 11 and in terminal 2 is labelled element 12. In the terminal 1 illustrative of a single conductor connection, the conductor position 8 is continued as 13 coiled around a post 14 thereby providing mechanically supported electrical interconnection to an external lead 15. Similarly, for the terminal 2, illustrative of a plural conductor connection, the portions 9, and 10 are continued as 16 and 17 coiled around post 18 thereby providing a mechanically supported electrical connection that can serve as a joint in the coil 4 winding.

The base members 11 and 12 each have a bonding face 19 and holes 20, 21 and 22 adequate in size for the passage of the conductor portions 8, 9, and 10 from the coil body to the posts 14 and 18. The base member 11, 12 may be of conductive material such as cooper or steel, or may be a non-conductive material such as ceramic. The base 11, 12 may be contiguous with the post 14, 18 or may be a separate component.

Means for electrical connection is shown for illustration as the simple case of a cylindrical post 14, 18 of conducting material about which the conductor 13, 16 and 17 is spiraled and soldered into position.

The bond 23 of the terminal base 11, 12 to the coil body 4 is achieved at the bonding face 19 and also at the lower peripheral surfaces of the base such as 24. The bond 23 is achieved by the adherence of an impregnating material to the surface 3 of the coil 4. The bonding surface may be abraided or coated with substances for the purpose of increasing the strength of the bond. The immediate vicinity of the bond 23 may be provided with glass or ceramic fiber content so as to strengthen the impregnated region adjacent to the bond surface by forming a filamentary composite consisting of the fiber and the impregnating substance. Satisfactory materials for impregnating the coil are polyester and epoxy based resins.

The area of the bonding face 19 of the terminal is by this invention a small fraction of the surface 3 of the coil 4 to which it is bonded, and therefore a small fraction of the area of a supporting surface that might be part of a form used to wind the coil.

In the terminal of the invention, conductor ends 8, 9 and 10 and electrical connections 13, 16 and 17 are supported by the terminal base member 11, 12 and post 14, 18 with all stresses being taken up by the base and post which, due to the bond 23 are now integral with coil 4 so that the conductor ends are only relied upon for electrical current contact.

Figure 2:
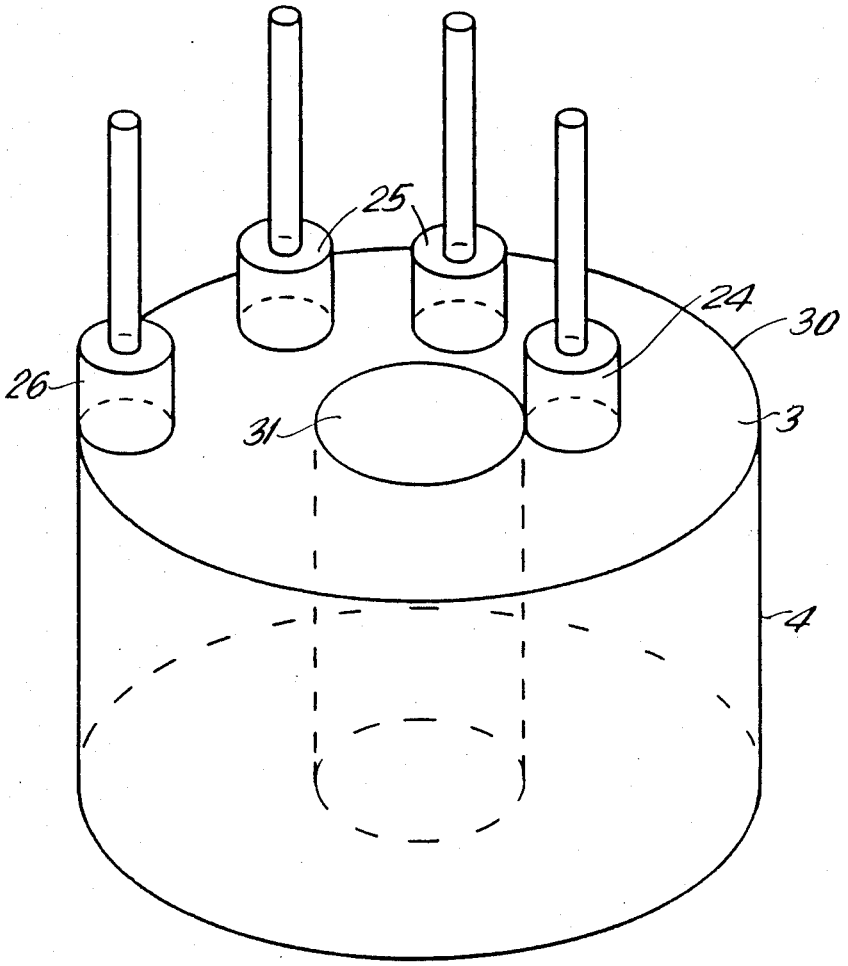
FIG. 2 is a perspective view of the coil element of the invention.

The invention provides the capability of producing a unitary superconductive magnetic element where all terminals are integral with the coil body structure. Referring to FIG. 2, the coil body 4 is illustrated as a solenoid 30 with bore area 31 and has integrally bonded to the surface 3 thereof a number of terminals of different types positioned at different locations. Bonded terminals of the type of terminal 1 in FIG. 1 may be positioned at positions 24 and 26 to accommodate the start and finish leads of the coil. Bonded terminals of the type of terminal 2 in FIG. 1 may be positioned at intermediate positions 25 to accommodate intermediate joints in the coil winding. The base 12 of FIG. 1 used in positions 25 may be provided with many openings to allow flexibility in which the layers of conductor which pass under the base of the terminal the intermediate joint is made.

There are reasons why it may be desirable to make the terminal base and terminal post of different materials, as would best be suited to their different functions of bonding to the coil and facilitating the electrical connection.

Figure 3:
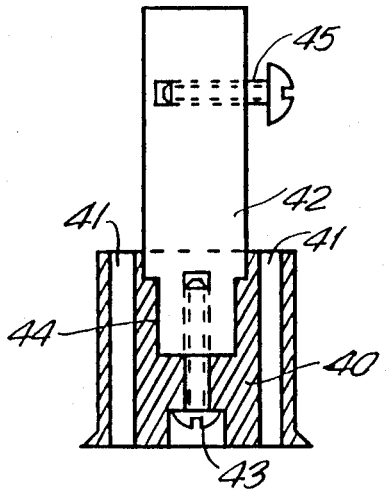
FIG. 3 is a cross sectional view of a terminal employing different materials.

In FIG. 3, a terminal assembly is shown in which the base 40, which contains a multiplicity of holes 41 for conductors, is connected to a separate post 42 by means of a screw 43 inserted through the bottom of the base 40. The recess 44 in the base 40 helps to position and secure the post 42. The material of the base 40 could be steel or ceramic, while the post 42 might be copper. The screw 45 in the post 42 holds the conductor in place during heat treatment.

In accordance with the invention a process is provided for fabricating superconductive magnetic elements that is independent both in manufacturing and in service of the ductility of the material used in the conductor yet is compatible with the particular wire assembly and subsequent reacting conditions of the types of conductor materials that require them.

In general the process requires that the coil be wound and all leads be positioned in terminal assemblies which are held in fixed relation to the coil winding, that heat treatment of the coil be performed, if required, on the particular conductor, that the electrical connections be made, for example by soldering, after heat treatment, if not made by reaction processes during heat treatment, that the coil be impregnated or the terminals be bonded by an alternate application of adhesive, and that thereafter the fixtures associated with holding the terminals in position during this process be removed.

The process is described in connection with FIG. 4 specifying the considerations for a "wind and react" type of conductor so that where the conductor does not require a heat treatment to form the superconducting properties, appropriate simplification will be readily apparent.

Figure 4:
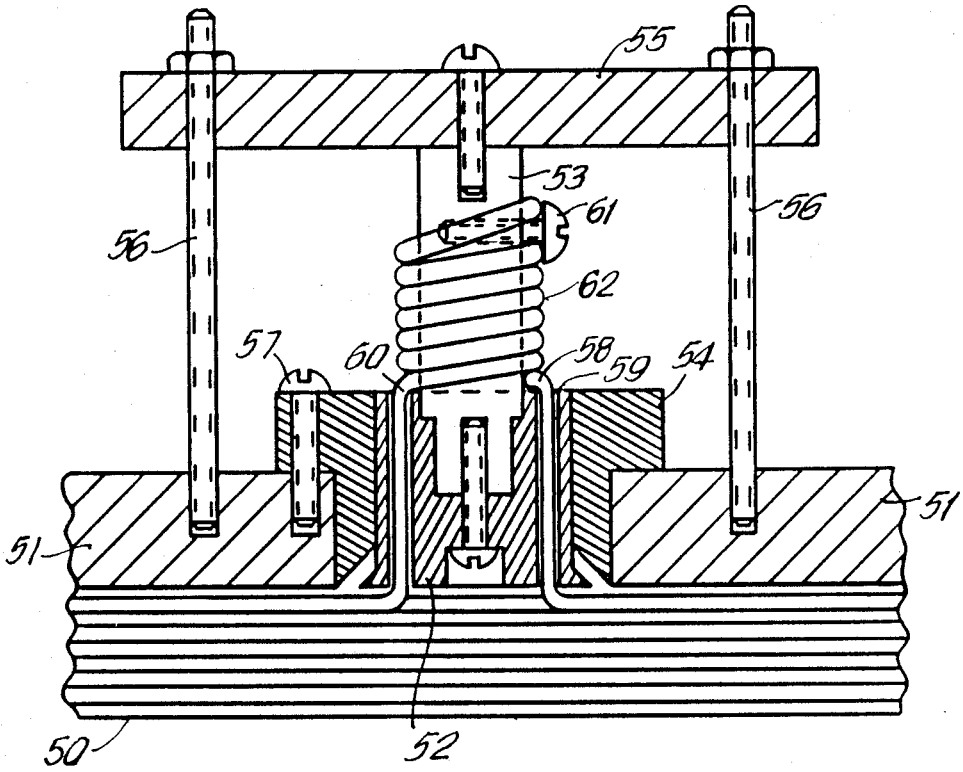
FIG. 4 is a cross sectional view illustrating the invention at an intermediate manufacturing stage.

Referring to FIG. 4 at the stage of the process illustrated the coil has been wound. The cutaway cross sectional view of FIG. 4 shows a coil layer in which an intermediate joint in the conductor is being made. The coil body 50 is wound in a forming member including winding support member 51 attached to which is a terminal assembly with base 52 and post 53 positioned with respect to support member 51 and held in place by collar 54. Additional structure to secure and hold the terminal in position may be employed, such as the bridge 55 connecting the terminal post 53 to the support member 51 by rods 56. The collar 54 may be secured to the support member 51 by means of the screw 57 for example. The terminal assembly can be positioned before winding. During the wind process, for a layer which lies under the terminal base, the lead wire 58 can be brought through terminal base hole 59 to begin the next layer. The wires 58 and 60 are placed in proximity on the post 53 and held in position by screw 61, for example. The remainder of the coil is wound and a final terminal connection is made using the single conductor of the final exit lead.

In a "wind and react" process, by definition the superconducting properties of the conductor are formed in a heat treatment after coil winding. The material of the terminal assembly are compatible with the high temperature of the heat treatment. During the heat treatment, an electrical connection of the conductor in the joint region 62 may occur if provisions has been made for the fusion or reaction of the extensions of leads 58 and 60 to one another.

Following heat treatment, the leads in the region 62 can be soldered for mechanical support and electrical connection, if such electrical connection has not been provided for and accomplished during heat treatment.

The electrical connection of the leads, by any means, need not be in the immediate proximity of the coil, as the length of the post 53 may extend a distance from the coil and the leads supported along the extended post, for example by soldering, at a joint region such as 62 positioned at a distance from the coil.

The coil is then impregnated with a substance such as epoxy resin which provides strength and immobility to the windings in the coil body 50 and provides a bond to the terminal base 52. The epoxy serves also to secure the conductor sections 58 and 60 preventing motion within the holes 59 in the base 52.

After the coil 50 is impregnated and the impregnating substance cured to hardened state the collar 54 and any additional structure connected to the terminal such as bridge 55 is removed. The terminal assembly is then structurally independent of the support member 51, which may be removed from the coil body or left in place according to the preference of the individual design. Any subsequent motion of the support member 51 which does not eliminate the clearance left by the removal of the collar 54, will not apply stress to the terminal assembly and the bond between terminal base and coil.

The conductor associated with the terminal is not moved or reshaped by any step in the process after the initial forming of the leads. In particular the conductor is not moved or reshaped after the heat treatment in which the superconducting properties are formed. The resulting unitary structure of coil body and terminal assembly is independent of the support structure used in the formation of the windings of the coil body.

What is claimed is:

1. A terminal for providing an electrical connection to at least one conductor end portion extending from the surface of an impregnated superconductor magnetic element comprising in combination:

a terminal base member;

a coil body contacting face, a portion of said coil body contacting face adapted for electrical connection, and at least one opening for extending through said contacting face for accommodating a conductor;

bonding means integrally retaining said base member to less than a portion of said contacting face which is less than the entire surface thereof, thereby reducing stresses at the interface; and an electrical connection for said conductor end portion.

2. The terminal 1, including a bridging member operable to hold a terminal assembly consisting of base and electrical connection member in fixed position during the processing of the coil at least until the bond from the terminal to the coil body is achieved.

3. The terminal of claim 3, including a collar member surrounding said base member.

4. The terminal of claim 1, wherein said bonding member forms a bond between said contacting face and the material impregnating said coil body.

5. The terminal of claim 4, wherein said bonding member is of epoxy resin.

6. The terminal of claim 1, wherein said conductors are of material taken from the group $Nb_3Sn$ and $V_3Ga$.

7. The terminal of claim 1, wherein said conductors are of NbTi.

8. The terminal of claim 1, wherein said conductors are of material taken from the group of metal oxide ceramic superconductors.

9. The terminal of claim 1, wherein said base member is a material taken from the group of copper, steel and ceramic.

10. The process of manufacturing superconductive magnetic elements, comprising the steps of:

forming a coil body of at least one material requiring further processing to serve as the superconductive conductor;

positioning each conductor end in a supporting member which is held in fixed position with respect to the coil body, and which provides mechanical constraint to the conductor end;

subjecting said coil body to said further processing conditions for said superconductor;

bonding said support to the surface of said coil body and providing electrical connection to each said conductor end;

connecting said supporting member to the structure used to hold and shape coil body; and spacing of said supporting member from the structure holding the coil body being achieved by means of an intermediate manufacturing collar which fits about the conductor supporting member said intermediate manufacturing collar being removed after processing is complete.

11. The process of claim 10, wherein said step of bonding comprises the step of impregnating said coil body with a material that fills the interstices thereof.

* * * * *